United States Patent [19]

Neal

[11] 4,092,565

[45] May 30, 1978

[54] PULSE CIRCUIT FOR GASEOUS DISCHARGE LAMPS

[75] Inventor: Wayne R. Neal, Hendersonville, N.C.

[73] Assignee: General Electric Company, New York, N.Y.

[21] Appl. No.: 743,566

[22] Filed: Nov. 22, 1976

[51] Int. Cl.[2] ..... H05B 41/231; H05B 41/30

[52] U.S. Cl. ..... 315/283; 315/200 R; 315/208; 315/242; 315/244; 315/290; 315/DIG. 7

[58] Field of Search ..... 315/200 R, 205, 208, 315/209 R, 240, 241 R, 242, 244, 283, 290, DIG. 7

[56] References Cited

U.S. PATENT DOCUMENTS

| | | | |
|---|---|---|---|
| 3,555,302 | 1/1971 | Nuckolls | 315/240 X |
| 3,629,683 | 12/1971 | Nuckolls | 315/242 X |
| 3,890,537 | 6/1975 | Park et al. | 315/209 R X |
| 3,919,592 | 11/1975 | Gray | 315/241 R X |
| 3,953,763 | 4/1976 | Herrick | 315/DIG. 7 |
| 3,963,945 | 6/1976 | Colyn | 315/241 R X |

*Primary Examiner*—Eugene R. La Roche
*Attorney, Agent, or Firm*—Sidney Greenberg

[57] ABSTRACT

Circuit operating from a direct current source applies DC pulses to a high pressure sodium vapor lamp to improve the color rendition of the lamp. The circuit includes a first inductor, a diode and a capacitor connected across a DC source, and a second inductor, controlled thyristor switch and sodium vapor lamp connected in series across the capacitor, and a timing circuit for periodically turning on the switch at predetermined intervals. The circuit provides for charging the capacitor, commutating the controlled switch, and discharge of the capacitor to enable subsequent recharging thereof, so as to povide the desired pulsed operation of the lamp. This mode of operating also provides for application of voltage to the lamp which is substantially higher than the supply voltage.

15 Claims, 2 Drawing Figures

PULSE CIRCUIT FOR GASEOUS DISCHARGE LAMPS

Figure 1:
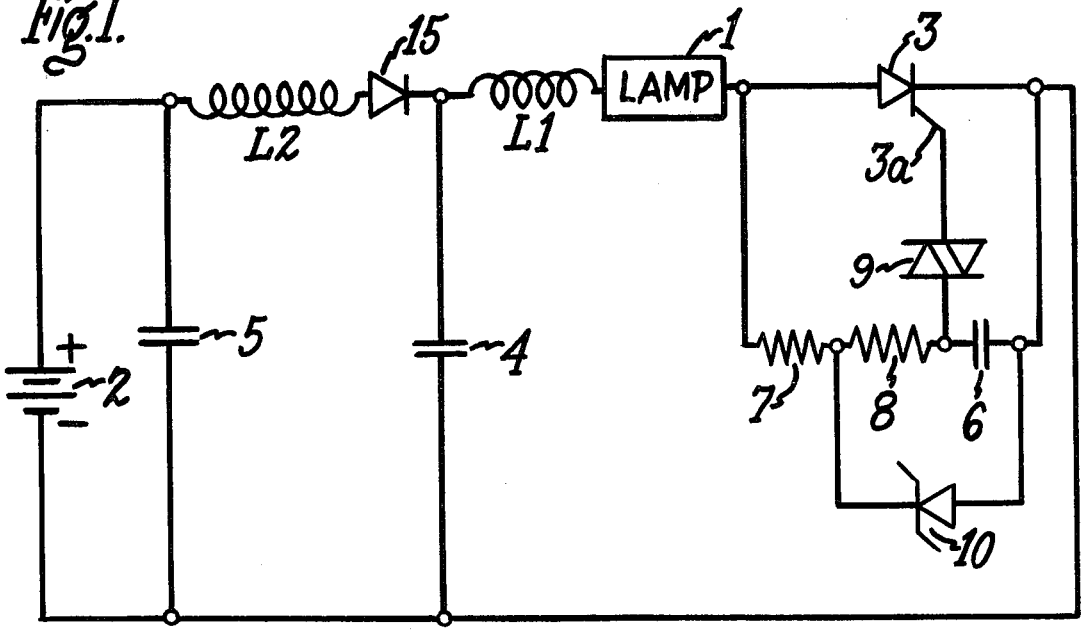

The present invention relates to operating circuits for gaseous discharge lamps, and more particularly concerns direct current operating circuits for sodium vapor discharge lamps.

It is an object of the invention to provide an improved DC operating circuit for pulsed operation of gaseous discharge lamps.

It is a particular object of the invention to provide an improved DC operating circuit for applying DC pulses to gaseous discharge lamps of high pressure sodium vapor type, to produce improved color properties of the lamp light output.

It is another object of the invention to provide a circuit of the above type which is simple in construction and efficient and reliable in operation.

Still another object of the invention is to provide a circuit of the above type which produces pulses of sufficiently high voltage to ensure continuous operation of the lamp.

Other objects and advantages will become apparent from the following description and the appended claims.

With the above objects in view, the present invention in one of its aspects relates to a lamp operating circuit comprising a direct current power source, a first inductor, unidirectional conducting means and a capacitor in series with each other across the power source, a second inductor and unidirectional controlled switch means connected in series across the capacitor, the second inductor having a lower inductance than the first inductor, a gaseous discharge lamp in series with the second inductor and the controlled switch means, and control means connected to the unidirectional controlled switch means for intermittently operating the same at predetermined intervals, whereby pulses are applied to the lamp for operation thereof.

A related type of circuit for DC pulsed operation of gaseous discharge lamps is disclosed in co-pending application Ser. No. 692,080 — Soileau, filed June 2, 1976 and assigned to the same assignee as the present invention.

The operating circuit of the invention may be used for applying DC pulses of predetermined duty cycle and repetition rate on the lamp for improving the color and other properties thereof. A method and apparatus for pulsed operation of high pressure sodium vapor lamps for improving the color rendition of such lamps are disclosed in co-pending application Ser. No. 649,900 — Osteen, filed Jan. 16, 1976 and assigned to the same assignee as the present invention.

As disclosed in the Osteen application, the high pressure sodium vapor lamp typically has an elongated arc tube containing a filling of xenon at a pressure of about 30 torr as a starting gas and a charge of 25 milligrams of amalgam of 25 weight percent sodium and 75 weight percent mercury.

The present invention provides an improved circuit for DC pulsed operation of such lamps in accordance with the method and principles disclosed in the co-pending Osteen application, and the disclosure thereof in that application is accordingly incorporated herein by reference. As there disclosed, pulses may be applied to the lamp having repetition rates above 500 to about 2,000 Hertz and duty cycles from 10% to 30%. By such operation, the color temperature of the lamp is readily increased and substantial improvement in color rendition is achieved without significant loss in efficacy or reduction in lamp life.

Figure 2:
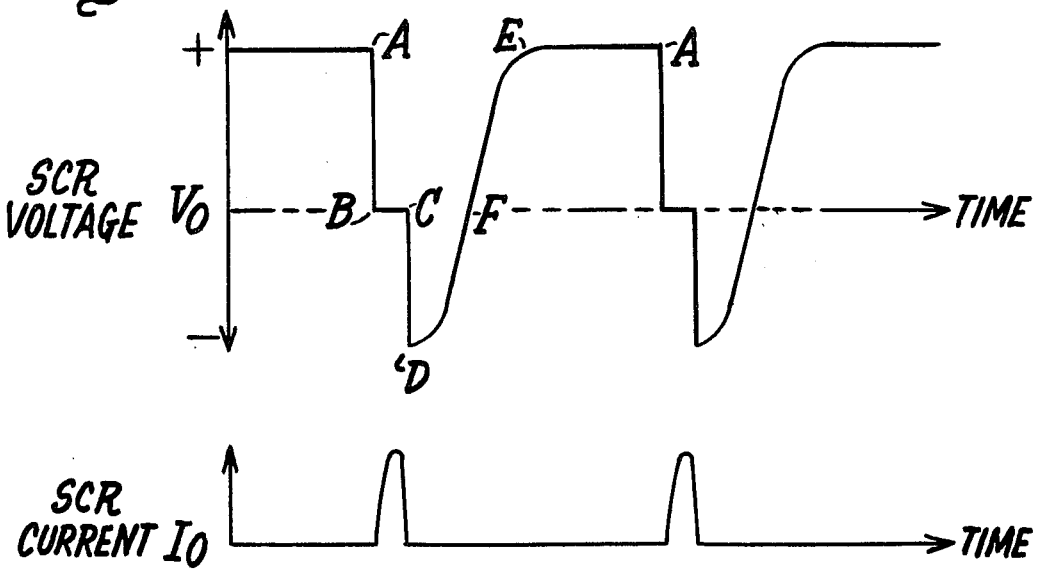

The invention will be better understood from the following description taken in conjunction with the accompanying drawing, in which:

FIG. 1 is a circuit diagram of a DC pulse operating circuit in accordance with an embodiment of the invention; and FIG. 2 is a graphical representation of the voltage and current waveforms relating to the operation of the circuit shown in FIG. 1.

Referring now to the drawing, and particularly to FIG. 1, there is shown a circuit diagram illustrating an embodiment of the DC pulsing circuit of the invention for operating a gaseous discharge lamp 1, which is typically a high pressure sodium vapor lamp such as described above.

Power supply 2 may be any suitable source of DC voltage, such as a battery or a rectified AC source. Preferably, the DC supply is at least about 150 volts in order to achieve the desired improvement in color properties of lamp 1 (assuming the lamp to be of 250–300 watt variety). Suitable circuits for obtaining direct current with low ripple factor which may be employed with the pulsing circuit of the invention are disclosed in co-pending applications Ser. No. 608,531 — Neal, filed Aug. 28, 1975 and Ser. No. 692,078 — Morais, filed June 2, 1976, both assigned to the same assignee as the present invention, and such disclosures are incorporated herein by reference.

Filter capacitor 5 connected across DC power supply 2 provides a filtered DC voltage supply for the pulse generating circuit described hereinafter. Inductor L2 is connected in series with diode 15 and capacitor 4 across filter capacitor 5. A second inductor L1, lamp 1 and a controlled unidirectional thyristor switch such as silicon controlled rectifier (SCR) 3 are connected in series across capacitor 4. The operation of SCR switch 3 is controlled by an RC timing circuit comprising, in the illustrated embodiment, capacitor 6 and resistors 7 and 8 connected across the SCR. A voltage breakdown device 9 constituted by a diac in the circuit shown is connected at one side to the junction of capacitor 6 and resistor 8 and at the other side to the control electrode (gate) 3*a* of SCR switch 3. Zener diode 10 is connected across capacitor 6 and resistor 8 of the timing circuit.

The inductance of inductor L2 is substantially higher than that of inductor L1, and in a typical circuit for practicing the invention the L2 inductance would be about 10 times that of L1. However, the ratio may be in the range of about 2:1 to about 50:1 or higher while still obtaining satisfactory results. In general, the L2 inductance should be sufficiently high to ensure proper discharging of capacitor 4 through the discharge circuit and to provide for sufficient reversal of the capacitor charge to commutate the SCR as described below.

It appears that the use of higher values of inductor L2 tends to reduce circuit losses. Also, it has been found that with sufficiently high inductance of inductor L2, diode 15 may be omitted while still providing for proper discharge of capacitor 4 as explained below, it being understood that if diode 15 is dispensed with, the values of capacitor 4 and inductor L2 should be such that the pulse voltage available in the circuit is sufficient to re-ignite the lamp.

In a typical circuit, the following components would have the values indicated:

Inductor L1 — 0.7 millihenries
Inductor L2 — 7 millihenries
Capacitor 4 — 3 microfarads
Capacitor 5 — 100 microfarads
Capacitor 6 — 0.12 microfarad
Resistor 7 — 41K ohms
Resistor 8 — 7K ohms
Zener diode 10 — 62 volts
Diode 15 — 1K volts
Diac 9 — 38 volts In the operation of the described circuit, capacitor 4, which serves as an energy metering device in the circuit, is charged by current flowing from filter capacitor 5 through inductor L2 and diode 15. The charge on capacitor 4 reaches a positive voltage substantially higher than the supply voltage. When SCR 3 is triggered on by operation of the RC timing circuit, capacitor 4 discharges through inductor L1, lamp 1 and SCR 3, and subsequently this energy (minus the amount dissiptated in the lamp) is returned to capacitor 4 but with the polarity of the voltage reversed, such that the upper electrode of capacitor 4 goes to a negative potential. This voltage reversal causes the SCR cathode voltage to be more positive than its anode voltage, and as a result commutation and turn-off of the SCR switch occurs. This negative potential is prevented from reversing again by SCR 3. Capacitor 4 is then again charged by supply current flowing through inductor L2 and diode 15 to a voltage higher than the supply voltage, and diode 15 serves to prevent the re-charged energy on capacitor 4 from returning to the supply source. The circuit remains quiescent until the next pulse is provided by operation of the RC timing circuit. The latter circuit is adjusted to trigger SCR 3 to produce pulses of desired repetition rate for pulsing lamp 1 in the manner intended.

On subsequent cycles, the positive voltage drop across SCR 3 increases to even higher levels, until an equilibrium potential is reached as a function of the total resistive losses in the circuit. This equilibrium potential can assume values greater than twice the supply voltage. In an illustrative case, with a supply voltage of about 180 volts, the equilibrium voltage across SCR 3 typically reaches about 450 volts during operation. Such high voltages, when imposed across lamp 1 during conduction of SCR 3, serve to ensure re-ionization and continued operation of the lamp, especially when the pulse repetition rate is relatively low.

The operation of the RC timing circuit is such that capacitor 6 is charged at a rate determined by the combination of resistors 7, 8 and capacitor 6. When the potential on capacitor 6 reaches the breakdown voltage of diac 9, capacitor 6 discharges through the loop including SCR control electrode 3*a* and turns on SCR 3. While a diac is shown as the voltage breakdown device 9, other breakdown devices such as a silicon bilateral switch (SBS), a Shockley diode, a glow tube, or a series combination of certain of these devices, could be employed.

Zener diode 10 connected to the junction of resistors 7 and 8 of the RC timing circuit stabilizes the frequency of the triggering operation by establishing a fixed clamping voltage toward which capacitor 6 is charged. Resistors 7 and 8 arranged as shown constitute a voltage divider, so that the use of a smaller Zener diode is made possible.

FIG. 2 graphically shows the SCR voltage and current pulse waveforms achieved after equilibrium is reached in the operation of the described circuit. The initial positive SCR voltage drop shown (anode positive with respect to cathode) prevails before the SCR is gated on. When the SCR switch is turned on at point A, as determined by the RC timing circuit, the voltage across the switch immediately drops to zero, as indicated at point B. The voltage remains zero while the current flows through the SCR switch. During this period, as seen in the SCR current waveform, the current rises to a peak value and then drops to zero due to operation of the LC circuit comprising inductor L1 and capacitor 4. The reversal of current is prevented by the SCR, and due to the large negative voltage (with respect to ground) on capacitor 4 as described previously, the SCR is reverse biased to achieve commutation. As the SCR ceases to conduct, as indicated at point C, the voltage drop across the SCR is reversed, i.e., assumes a negative sense with its cathode voltage more positive than its anode voltage as indicated at point D. Capacitor 4 then charges through inductor L2 and diode 15 producing the SCR voltage waveform portion extending from D to E as the SCR anode potential is made positive by the reversal of charge on capacitor 4 due to the operation of inductor L2. The positive voltage drop is held at level E by diode 15 and SCR 3. The RC timing circuit starts the timing interval when the SCR voltage goes positive (point F) so that the interval from F to A is determined by the timing circuit.

Filter capacitor 5 is typically an electrolytic capacitor, which in comparison to other types of capacitors provides a large capacitance in a relatively small size. In contrast to the arrangement disclosed in the aforementioned co-pending Soileau application, where such a filter capacitor may be subjected to high pulse currents generated by the firing of the SCR switch and leading to excessive heating of the electrolytic capacitor which may unduly shorten its operational life, filter capacitor 5 in the present circuit is isolated from the SCR pulsing circuit and thereby avoids the foregoing disadvantage.

Lamp 1 may be arranged in various places in the discharge circuit of L1, SCR 3 and capacitor 4, or in series with inductor L2 and diode 15. Such modifications will produce varied but satisfactory results in accordance with the invention.

Inductor L1 may also be placed in various positions in the described discharge circuit while obtaining satisfactory results, and such modifications are intended to be included within the scope of the invention.

While an SCR is disclosed as the unidirectional controlled switch in the described circuit, it will be understood that other equivalent switch devices may alternatively be employed in accordance with the invention. For example, a triac or a transistor switch may be employed in combination with a diode to provide unidirectional operation, and as used herein the expression "unidirectional controlled switch means" is intended to include all such equivalent switch devices or arrangements. A high voltage starting circuit may be incorporated in the described circuit for starting lamp 1, as disclosed in the aforementioned co-pending Morais application.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A lamp operating circuit comprising, in combination, a direct current power source, a first inductor and a capacitor in series with each other across said power source, a second inductor and unidirectional controlled switch means connected in series across said capacitor, said second inductor having a lower inductance than said first inductor, means for connecting a lamp in series with said second inductor and said controlled switch means, and control means connected to said unidirectional controlled switch means for intermittently turning on the same at predetermined intervals, the ratio of the inductance of said first inductor to the inductance of said second inductor being sufficiently high to provide for commutation of said unidirectional controlled switch means, whereby pulses may be applied to a lamp connected to said lamp connecting means for operation thereof.

2. A circuit as defined in claim 1, and unidirectional conducting means connected in series with said first inductor and said capacitor.

3. A circuit as defined in claim 2, said lamp connecting means being arranged for connecting the lamp between said second inductor and said unidirectional controlled switch means.

4. A circuit as defined in claim 2, the ratio of inductance of said first inductor to the inductance of said second inductor being at least about 2:1.

5. A circuit as defined in claim 4, wherein said ratio of inductance is about 10:1.

6. A circuit as defined in claim 1, including a filter capacitor connected across said direct current power source, said first inductor and said first mentioned capacitor connected across said filter capacitor.

7. A circuit as defined in claim 6, said filter capacitor being an electrolytic capacitor.

8. A circuit as defined in claim 2, and a gaseous discharge lamp in series with said second inductor and said controlled switch means.

9. A circuit as defined in claim 8, wherein said gaseous discharge lamp is a high pressure sodium vapor lamp.

10. A circuit as defined in claim 1, wherein said controlled switch means comprises a silicon controlled rectifier.

11. A circuit as defined in claim 1, said control means comprising an RC timing circuit.

12. A circuit as defined in claim 11, and a Zener diode connected across said RC timing circuit for stabilizing the frequency of operation of said timing circuit.

13. A lamp operating circuit comprising, in combination, input terminals for connection to a source of electrical current, a first inductor and a capacitor in series with each other across said input terminals, a second inductor and unidirectional controlled switch means connected in series across said capacitor, said second inductor having a lower inductance than said first inductor, means for connecting a lamp in series with said second inductor and said controlled switch means, and control means connected to said unidirectional controlled switch means for intermittently turning on the same at predetermined intervals, the ratio of the inductance of said first inductor to the inductance of said second inductor being sufficiently high to provide for commutation of said unidirectional controlled switch means, whereby pulses may be applied to a lamp connected to said lamp connecting means for operation thereof.

14. A circuit as defined in claim 13, and a diode connected in series with said first inductor and said capacitor.

15. A circuit as defined in claim 14, said diode being between said first inductor and said capacitor.

* * * * *